US005462595A

United States Patent [19]

Im

[11] Patent Number: 5,462,595

[45] Date of Patent: Oct. 31, 1995

[54] INK PAD WITH REFILLABLE INK RESERVOIR

[76] Inventor: Jong P. Im, 4 E. Laburnum Ave., Richmond, Va. 23222

[21] Appl. No.: 355,960

[22] Filed: Dec. 14, 1994

[51] Int. Cl.[6] ..... B05C 21/00

[52] U.S. Cl. ..... 118/264; 101/103; 101/333; 118/266; 118/267; 118/269

[58] Field of Search ..... 118/264, 266, 118/267, 269; 15/104.92, 104.93; 101/103, 171, 333

[56] References Cited

U.S. PATENT DOCUMENTS

| | | | |
|---|---|---|---|
| 4,031,853 | 6/1977 | Conrad | 118/264 |
| 4,497,275 | 2/1985 | Johnson et al. | 118/268 |
| 5,152,223 | 10/1992 | Mairon | 101/334 |
| 5,259,878 | 11/1993 | Buan et al. | 118/264 |

*Primary Examiner*—Peter Chin
*Assistant Examiner*—Laura E. Edwards
*Attorney, Agent, or Firm*—Eugene Oak

[57] ABSTRACT

An ink pad device with ink reservoir for coating a stamping device with ink comprising ink reservoir, cap, housing, high-absorbency ink pad, low-absorbency ink pad and ink pad cover. The present invention incorporates an ink reservoir to an ink pad so that the ink pad device may be used indefinitely by refilling the ink reservoir with ink, thereby avoiding the predominant situation wherein the ink pad device is discarded when the ink in the ink pad is depleted and the ink pad subsequently dries up. The ink in the ink reservoir is absorbed by the high-absorbency ink pad located in the bottom of the housing and in turn the low-absorbency ink pad placed on top of the high-absorbency ink pad absorbs the ink in the high-absorbency ink pad, thereby preventing a given stamping device from acquiring excessive amount of ink from the ink pad device.

1 Claim, 3 Drawing Sheets

INK PAD WITH REFILLABLE INK RESERVOIR

FIELD OF THE INVENTION

The present invention generally relates to an ink pad and particularly to an ink pad which incorporates a refillable ink reservoir.

BACKGROUND OF THE INVENTION

The prior art discloses conventional ink pads with various functions, methods, layouts and constructions to provide means for supplying ink to stamping devices. Most conventional devices, however, possess a yet unresolved, common limitation of having a relatively short life expectancy. This life expectancy is dictated by the amount of ink in the ink pad and the capacity of the porous, and therefore evaporative, ink pad to retain the ink. A new conventional device initially contains and transfers excessive amount of ink to a stamping device, thereby leaving a heavy, smudged effect on the stamped document. This effect gradually transforms into that in which the conventional device contains and transfers minimal amount of ink to a stamping device, thereby leaving more of pressure relief than ink on the stamped document. This latter condition is a result of depletion of ink and/or dried up ink pad. At this stage, which may be a relatively short period of time since acquiring the conventional device, the device is discarded and a new unit is acquired.

It is thus a primary objective of the present invention to provide an ink pad with refillable ink reservoir.

Another objective of the present invention is to provide a means for ensuring a consistent ink stamp quality.

SUMMARY OF THE INVENTION

According to the present invention, there is provided an ink pad device with ink reservoir. The device comprises ink reservoir, cap, ink dispenser, ink pad housing, high-absorbency ink pad, low-absorbency ink pad and ink pad cover. The ink reservoir is composed of a rectangular box wherein a refilling hole is located at the middle of front surface of the reservoir. The filled ink in the reservoir is secured in place by a cap which plugs into the refilling hole. This cap is held captive to the reservoir by a chord. On the middle of lower front edge of the reservoir is an ink dispenser which points toward the bottom. The ink reservoir placed in an upright position when in use is pivotally and orthogonally connected along the lower back edge to a rectangular housing. On the bottom of the housing is a high-absorbency ink pad which is in contact with an opening located at the end of the ink dispenser. The high-absorbency ink pad becomes saturated with ink which is dispensed from the opening of the ink dispenser. Placed on top of the high-absorbency ink pad is a low-absorbency ink pad. The top surface of the low-absorbency ink pad, onto which the stamping device is applied to transfer the ink, is in plane of the top edges of the side walls of the housing. The combination of the low-absorbency ink pad placed on top of high-absorbency ink pad receives the ink from the reservoir, holds it in check and transfers optimum amount of ink to the stamping device. Finally, a rectangular ink pad cover is pivotally connected along its bottom edge to the edge where the front bottom edge of the ink reservoir meets the housing.

These together with other objects of the invention are pointed out clearly in the claims annexed to and forming a part of this disclosure. For a better understanding of the present invention, its operating advantages and the specific objects attained by its use, references should be made to the accompanying drawings and descriptive matter in which there are illustrated preferred embodiments of the invention.

BRIEF DESCRIPTION OF THE DRAWING

For a better understanding of the principle and nature of the present invention, references should be made to the following detailed description taken in consideration of the accompanying drawings in which.

DETAILED DESCRIPTION OF THE PREFERRED EMBODIMENT

Figure 1:
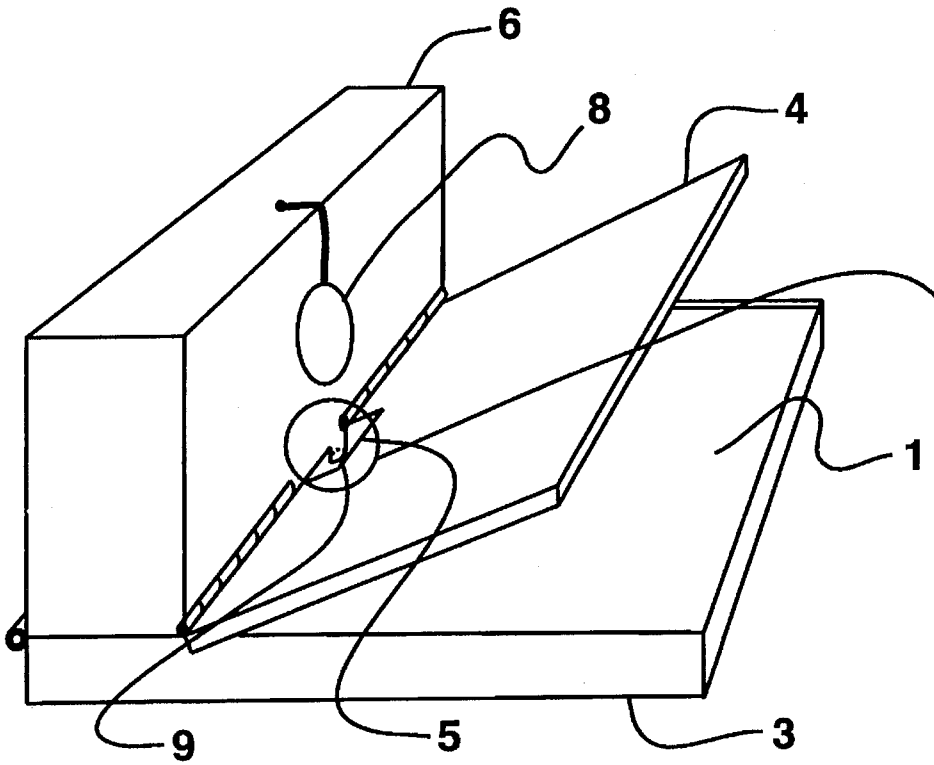
FIG. 1 is a perspective view of the ink pad illustrating the ink reservoir in its upright position and the ink pad cover partially open.
Figure 4:
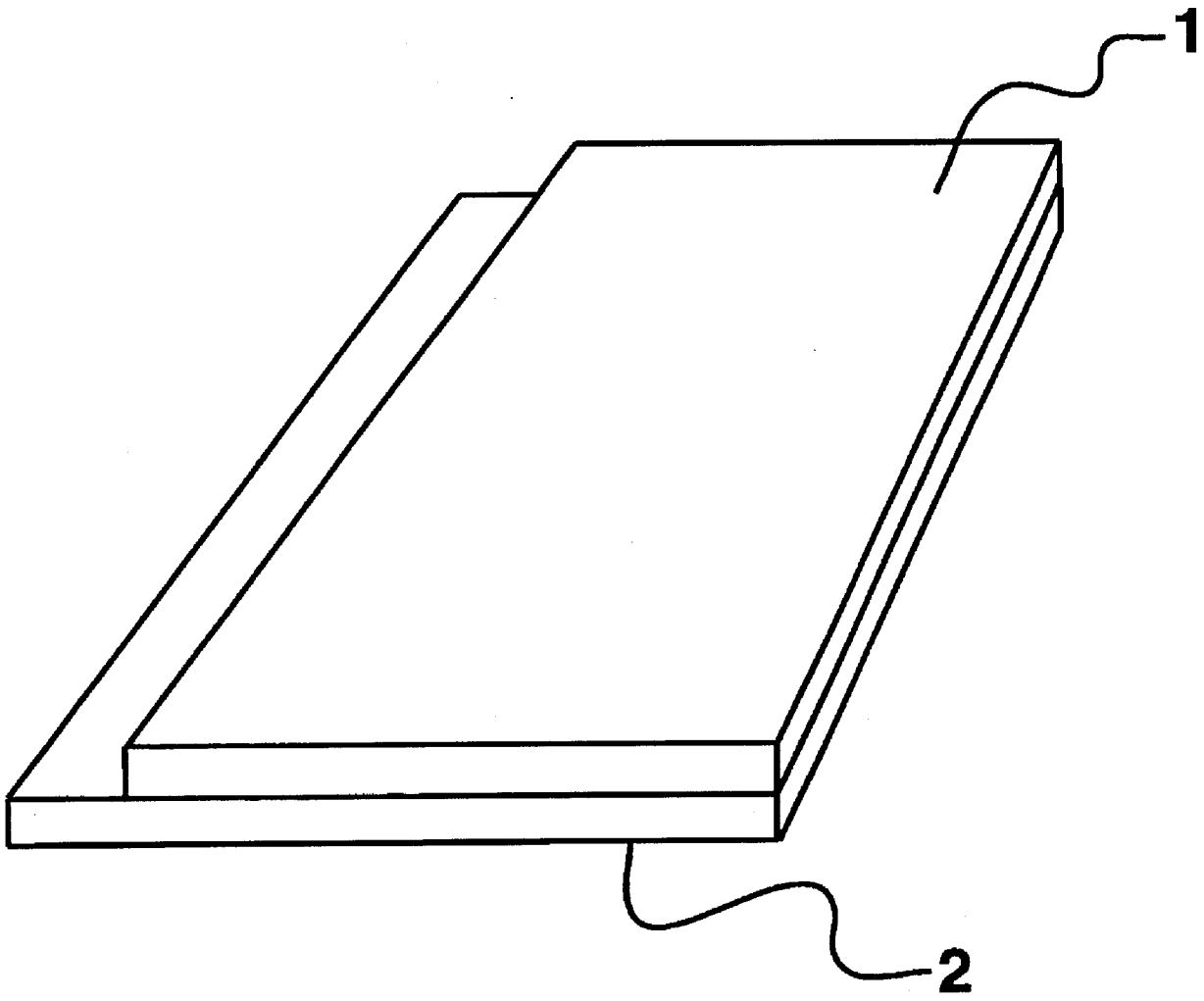
FIG. 4 is a perspective view of the low-absorbency ink pad stacked on top of high-absorbency ink pad.

Referring to FIG. 1, the rectangular ink pad housing 3 contains low-absorbency ink pad 1 (and high-absorbency ink pad 2, which is located below the low-absorbency ink pad 1 as shown in FIG. 4). With width referring to the distance from the front to the rear of the ink pad, the dimension of width of the opening on top of the rectangular ink pad housing 3 is less than the dimension of width of the rectangular ink pad housing 3.

The dimension of width of the low-absorbency ink pad 1 is less than the dimension of width of the high-absorbency ink pad 2, but the length of the low-absorbency ink pad 1 is equal to the high-absorbency ink pad 2. The dimension of collective thickness of the low-absorbency ink pad 1 and the high-absorbency ink pad 2 is marginally less than the dimension of inside height of the side wall of the ink pad housing 3.

Figure 3:
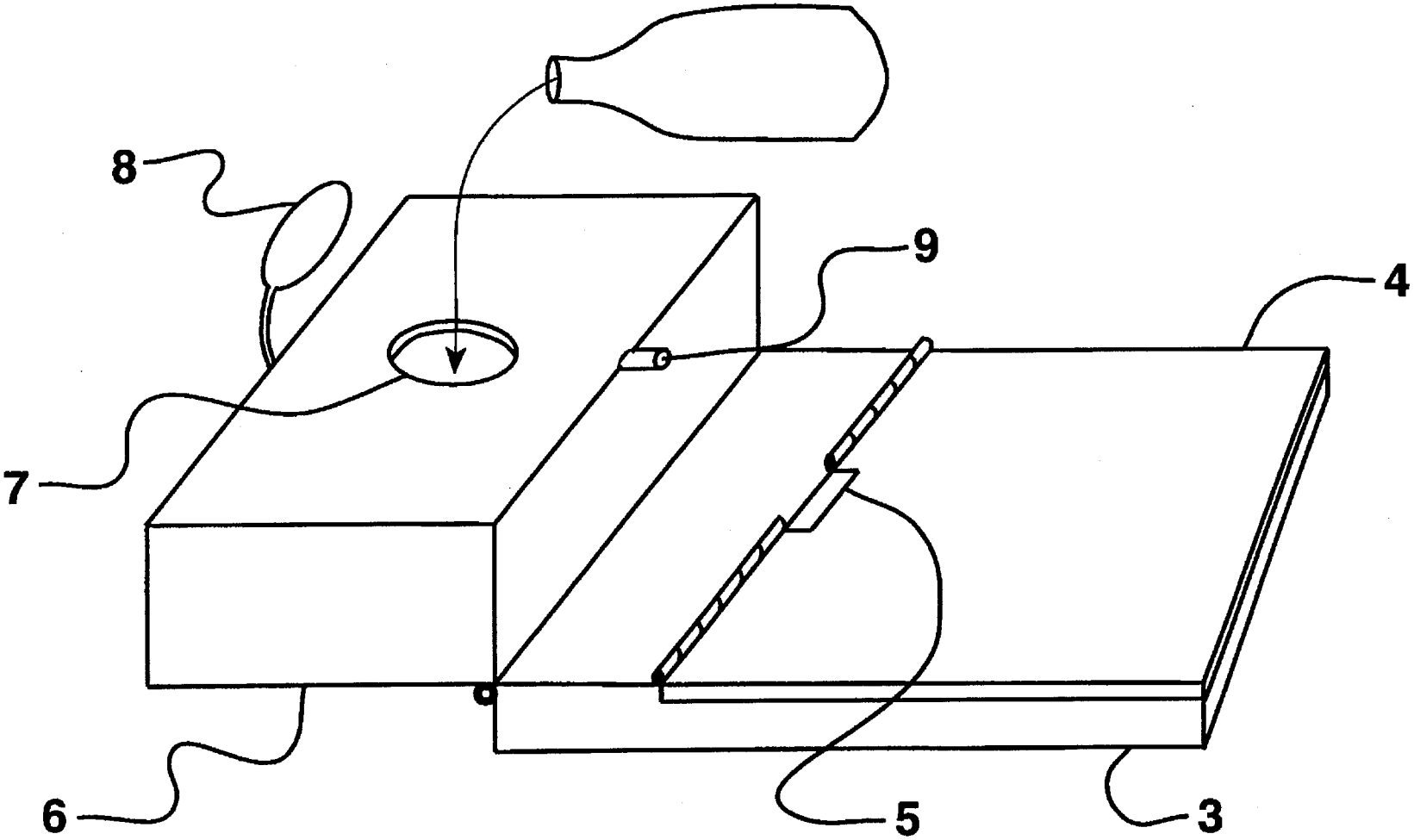
FIG. 3 is a perspective view of the ink pad illustrating the ink reservoir in its tilted position so as to facilitate the refilling of the ink reservoir.

Referring to FIGS. 1 and 3, ink pad cover 4 is pivotally attached to the rear edge of the opening on top of the ink pad housing 3. A rectangular opening 5 is located at the mid area of the rear edge of the ink pad cover 4. A rectangular ink reservoir 6 is pivotally attached to the upper rear edge of the ink pad housing 3. The dimension of width of bottom surface is equal to the difference in dimensions of width of the opening on top of the rectangular ink pad housing 3 and the width of the rectangular ink pad housing 3.

Tilting the ink pad housing 3 back as in FIG. 3 facilitates refilling the ink pad housing 3 through the refilling hole 7. Once full, cap 8 which is attached via a cord to the ink reservoir 6 is fitted over the refilling hole 7, thereby securing the ink in the ink reservoir 6.

Figure 2:
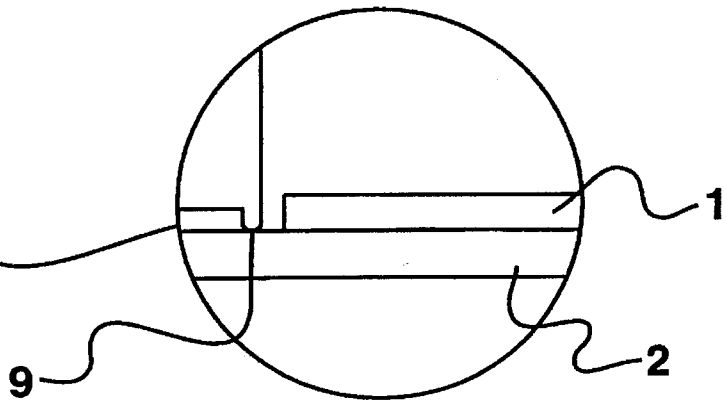
FIG. 2 is a closeup side view of ink dispenser in contact with upper surface of high-absorbency ink pad.

As in FIGS. 1 and 2, tilting the ink reservoir 6 to its upright position squarely places the ink dispenser 9 through and inside the rectangular opening 5 on the ink pad cover 4. Furthermore, the opening at the bottom tip of the ink dispenser 9 bypasses or clears the rear edge of the low-absorbency ink pad 1 and comes in contact with the top surface at the rear portion of the high-absorbency ink pad 2.

Per FIGS. 1, 2 and 3, the high-absorbency ink pad 2 absorbs the ink dispensed through the ink dispenser 9 and that ink is in turn absorbed at a lower absorption rate and therefore quantity by the low-absorbency ink pad 1.

What is claimed as being new and therefore desired to be protected by letter patent of the United States is as follows:

1. An ink pad device comprising:

a) an ink reservoir, said reservoir including a rectangular box, wherein a refilling hole is located centrally at a front surface of said box;

b) an ink dispenser, said dispenser including a round tube, wherein said dispenser is oriented vertically, wherein a top end of said dispenser is attached centrally to a lower front edge of said reservoir;

c) a cap, wherein said cap is attached to said reservoir by a chord;

d) a housing including a bottom surface and four side walls, wherein said reservoir is pivotally connected along its lower front edge to a top edge of a rear side wall of said housing;

e) a first ink pad including a rectangular, porous material, said first ink pad being on the bottom surface of said housing, wherein a bottom end of said dispenser is in contact with said first ink pad;

f) a second ink pad including a rectangular, porous material having an absorption capacity which is lower than that of said first ink pad, wherein said second ink pad is placed on top of said first ink pad, wherein a top surface of said second ink pad aligns with top edges of said side walls of said housing; and g) an ink pad cover including a rectangular panel having an opening for receiving said dispenser, wherein said cover is pivotally connected along a rear bottom edge to said housing and said rear bottom edge of said cover meets with said lower front edge of said reservoir.

* * * * *